United States Patent [19]

Knoble

[11] 4,051,410

[45] Sept. 27, 1977

[54] DISCHARGE LAMP OPERATING CIRCUIT

[75] Inventor: David W. Knoble, East Flat Rock, N.C.

[73] Assignee: General Electric Company, New York, N.Y.

[21] Appl. No.: 719,763

[22] Filed: Sept. 2, 1976

[51] Int. Cl.[2] ..... H05B 41/34

[52] U.S. Cl. ..... 315/205; 315/206; 315/207; 315/221; 315/269; 315/272; 315/DIG. 7

[58] Field of Search ..... 315/205, 206, 207, 208, 315/221, 269, 272, 219, DIG. 7

[56] References Cited

U.S. PATENT DOCUMENTS

| | | | |
|---|---|---|---|
| 3,389,300 | 6/1968 | Walter et al. | 315/219 X |
| 3,767,970 | 10/1973 | Collins | 315/DIG. 7 |

*Primary Examiner*—Alfred E. Smith

*Assistant Examiner*—Charles F. Roberts

*Attorney, Agent, or Firm*—Sidney Greenberg

[57] ABSTRACT

Color properties of high pressure sodium vapor discharge lamps are improved by disclosed operating circuit for applying pulsed direct current to the lamp. The circuit comprises a direct current supply circuit, a transistor switch in series with the lamp and the primary of a transformer connected across the supply circuit, a diode in series with the secondary of the transformer connected across the supply circuit, and SCR switch connected across the secondary of the transformer, and a control circuit connected to the switches for applying DC pulses to the lamp at a predetermined repetition rate and duty cycle. The circuit produces pulse waveforms which provide substantial color improvement in the lamp and makes efficient use of the energy supplied from the power source.

17 Claims, 6 Drawing Figures

DISCHARGE LAMP OPERATING CIRCUIT

The present invention relates to discharge lamp operating circuits, and more particularly concerns direct current operating circuits for such lamps.

It is an object of the invention to provide an improved direct current operating circuit for applying direct current pulses on gaseous discharge lamps, especially of high pressure sodium vapor type, to produce improved color properties of the lamp.

It is a particular object of the invention to provide a circuit of the above type which produces current waveforms of rapid rise and fall for effecting marked increase in the color temperature of high pressure sodium vapor lamps.

It is another object of the invention to provide a circuit of the above type which produces a high level of lamp system efficacy.

Other objects and advantages will become apparent from the following decription and the appended claims.

With the above objects in view, the present invention in one of its aspects relates to a lamp operating circuit comprising, in combination, a direct current power source, first controlled switch means and a gaseous discharge lamp in series therewith across the power source, unidirectional conducting means connected across the power source, a transformer having a primary winding connected in series with the first controlled switch means and the lamp and a secondary winding connected in series with the unidirectional conducting means, second controlled switch means connected across the secondary winding, and control means coupled to the first and second controlled switch means for repetitively and sequentially operating the same at predetermined intervals, whereby DC pulses are applied to the gaseous discharge lamp for operation thereof.

The arrangement is such that when the first controlled switch means is opened, the described circuit operates to store a portion of the transformer energy in the power supply, and when the second controlled switch means is closed, the remaining transformer energy is maintained as a circulating current in the secondary winding.

The operating circuit of the invention may be used for applying DC pulses of predetermined duty cycle and repetition rate on the lamp for improving the color and other properties thereof. A method and apparatus for pulsed operation of high pressure sodium vapor lamps for improving the color rendition of such lamps are disclosed in co-pending application Ser. No. 649,900 - Osteen, filed Jan. 16, 1976 and assigned to the same assignee as the present invention.

As disclosed in the Osteen application, the high pressure vapor lamp typically has an elongated arc tube containing a filling of xenon at a pressure of about 30 torr as a starting gas and a charge of 25 milligrams of amalgam of 25 weight percent sodium and 75 weight percent mercury.

The present invention provides an improved circuit for DC pulsed operation of such lamps in accordance with the method and principles disclosed in the co-pending Osteen application, and the disclosure thereof in that application is accordingly incorporated herein by reference. As there disclosed, pulses may be applied to the lamp having repetition rates above 500 to about 2,000 Hertz and duty cycles from 10% to 30%. By such operation, the color temperature of the lamp is readily increased and substantial improvement in color rendition is achieved without significant loss in efficacy or reduction in lamp life.

The circuit of the present invention is also useful for operating discharge lamps containing mixed metal vapors such as the above described lamp or other lamps in a manner to avoid color separation therein, in accordance with the method and principles disclosed in co-pending application Ser. No. 701,333 - Owen, filed June 30, 1976 and assigned to the same assignee as the present invention. The disclosure thereof in the said Owen application is accordingly also incorporated herein by reference.

The invention will be better understood from the following description taken in conjunction with the accompanying drawings, in which:

FIG. 1 is a circuit diagram of a lamp operating circuit showing an embodiment of the invention;

FIG. 1*a* and 1*b* show modifications of the FIG. 1 circuit;

Figure 1:
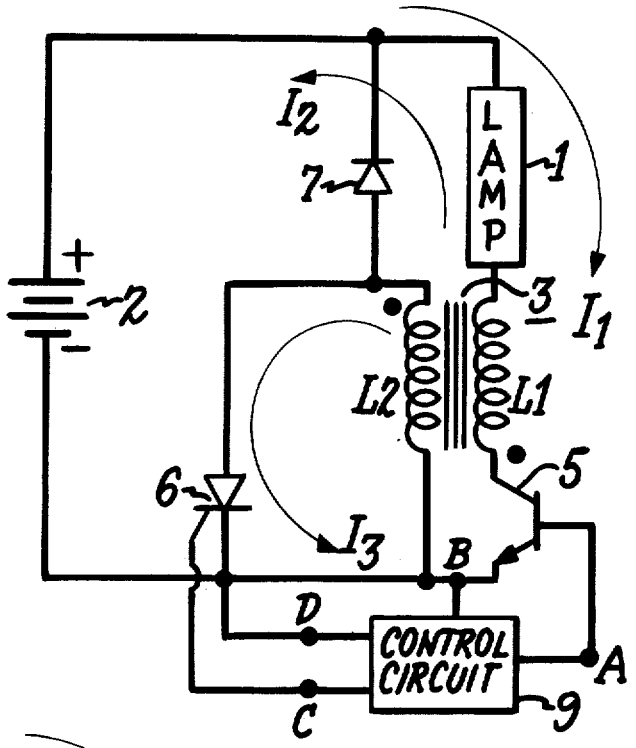

Referring now to the drawings, and particularly to FIG. 1, there is shown a circuit diagram illustrating an embodiment of the DC pulsing circuit of the invention for operating a gaseous discharge lamp 1, which is typically a high pressure sodium vapor lamp as described above. The circuit includes a DC supply source 2, such as a battery, to which is connected a pulsing circuit comprising two parallel branches across the supply source. One branch includes lamp 1 connected in series with primary winding L1 of transformer 3 and transistor 5, and the other branch comprises diode 7 connected in series with transformer secondary winding L2. As indicated in the drawing, the primary winding and the secondary winding are arranged or connected so as to be out of phase with one another. Connected across secondary winding L2 as shown is silicon controlled rectifier (SCR) switch 6. Transistor switch 5 and SCR switch 6 are operated repetitively and sequentially, as more fully explained below, by timing (control) circuit 9 connected to the base of transistor 5 and the gate electrode of SCR 6. Control circuit 9 is shown in detail in FIG. 3.

Figure 2:
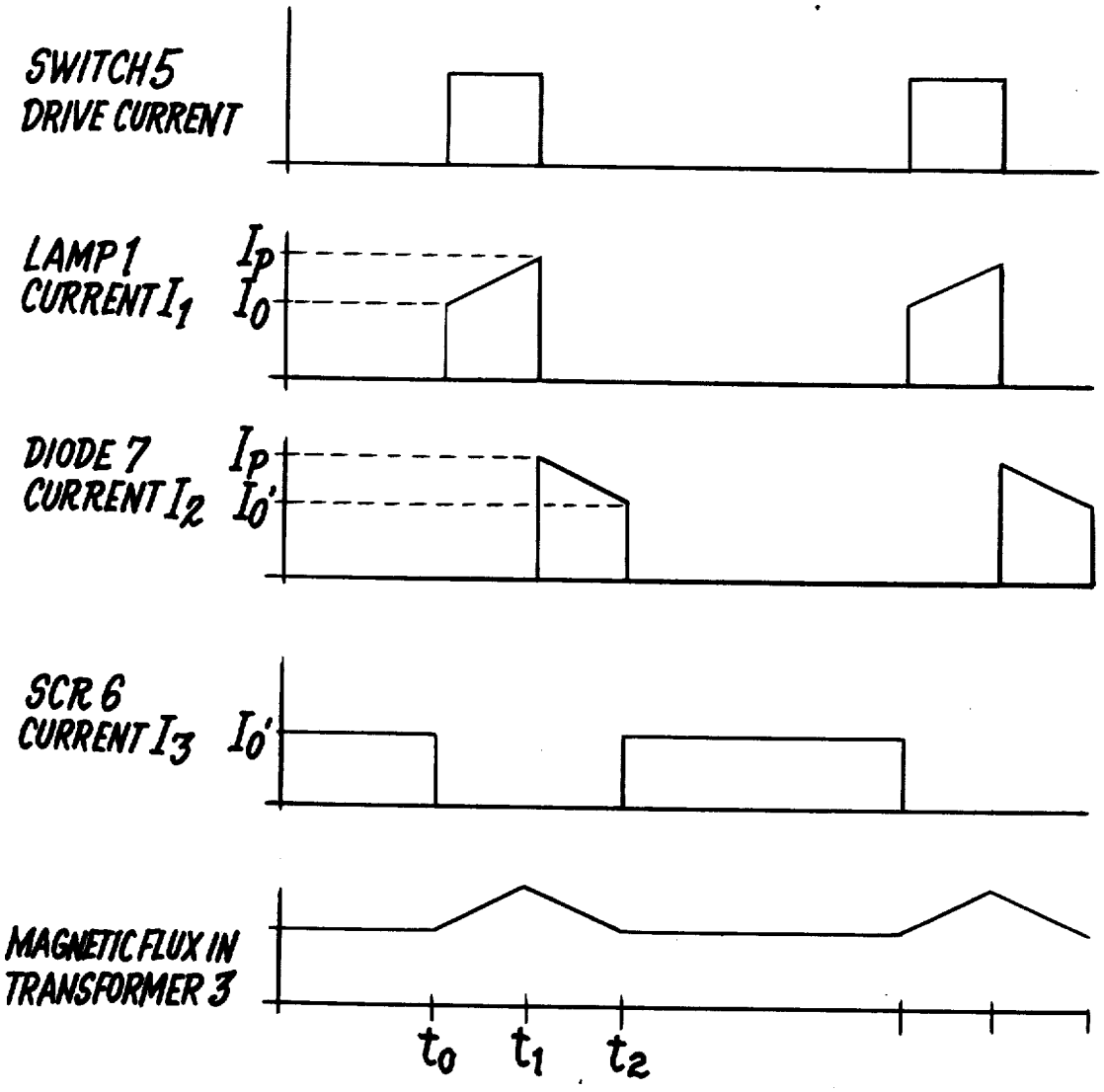
FIG. 2 shows a number of current waveforms relating to the operation of the FIG. 1 circuit.

In the operation of the described circuit, and with reference to the waveform diagrams of FIG. 2, when transistor switch 5 closes at time $t_o$, a current $I_1$ begins to flow through lamp 1 and transformer primary L1. This current increases with a time constant L/R where L is the inductance of primary winding L1 and R is the effective resistance of lamp 1. At time $t_1$, switch 5 opens, thereby interrupting current flow through the lamp and winding L1. At this time, there is energy stored in the magnetic field produced by the transformer current, the amount of energy being $1/2\ LIp^2$, where Ip is the peak current flowing when switch 5 opens. This energy should either by stored in the circuit or dissipated in lamp 1, since to dissipate it elsewhere would decrease the efficiency of the lamp operating circuit. In accordance with the present invention, this energy is stored in two ways, as described below. When switch 5 opens at time $t_1$, the magnetic field in transformer 3 begins to collapse, generating a voltage on both the primary and secondary windings. This voltage is of such polarity that when the voltage exceeds the supply voltage, a current $I_2$ will flow into the power source. Current $I_2$ is initiated at some high value Ip' (see FIG. 2), such that $N_S Ip' = N_p Ip$, where $N_S$ and $N_P$ denote the number of turns on the secondary and primary windings, respectively. Current $I_2$ decreases at a rate V/L', where V is the power supply voltage and L' is the inductance of secondary winding L2. Current $I_2$ continues to flow until it reaches a value of about $I_o$ at time $t_2$. Then SCR switch 6 is triggered on by control circuit 9 and current $I_2$ ceases, while current $I_3$ is initiated and circulates through the loop containing secondary winding L2 and SCR switch 6 as shown in FIG. 1. This current decays with a time constant L'/R' where R' is the resistance of SCR 6 and secondary winding L2. Since R' is quite small, this time constant is quite long, and current $I_3$ does not decay appreciably. Current $I_3$ continues to flow until transistor switch 5 closes again, which results in commutation (turn-off) of SCR 6 and begins a new cycle.

A better understanding of the operation of the circuit will be obtained by a consideration of the energy flow and storage during various times of the described cycle. At the instant switch 5 closes (at time $t_o$), there is a current $I_1$ of instantaneous value $I_o$ flowing in induction coil L1. This represents an amount of energy stored in the inductor of $E_1 = \frac{1}{2} LI_o^2$. Just prior to the instant switch 5 opens at time $t_1$, a current $I_1$ of value Ip is flowing through inductor L1 representing a stored energy of $E_2 = \frac{1}{2}$ LIp². Thus, the stored energy in the inductor has increased by $\Delta E = \frac{1}{2} L (Ip^2 - I_o^2)$ during this part of the cycle. In order to being the next cycle with a current value of $I_o$, this energy, i.e., Δ E, must be removed from transformer 3 during the remainder of this cycle. This is accomplished in the following manner. When switch 5 opens and current $I_2$ begins to flow, the energy stored in transformer 3 is $E_2$. As the current through L2 and diode 7 decays to $I_o$, the energy Δ E is returned to the power supply. It is only after this energy is returned to the power supply that SCR 6 is turned on (time $t_2$). If the SCR were turned on at time $t_1$ instead of $t_2$, or if a diode were used in place of the SCR, then this energy Δ E would be dissipated in the SCR (or diode) and inductor L2. This would represent a power loss approximately equal to the lamp power, and would accordingly be undesirable. However, most of this increment of stored energy is returned to the power supply, thus providing a highly efficient lamp ballast system which results in a high level of lamp system efficacy (lumens per watt). While SCR 6 is on, very little energy is dissipated, since the current is decaying only slightly, as previously noted. Thus, there is a base amount of stored energy $E_1$ in transformer 3 to which an increment Δ E is added in the time period $t_o - t_1$ and then subtracted in the time period $t_1 - t^2$ in each cycle. As a result, a waveform as depicted in FIG. 2 representing the lamp current is produced characterized by a fast rise and fall. It has been found that such a waveform is particularly desirable in order to provide a substantial increase in color temperature of the gaseous discharge lamp in accordance with the principles disclosed in the aforementioned Osteen application.

As will be understood, the desired pulse repetition rate and duty cycle to obtain improved color properties of the lamp as disclosed in the aforementioned Osteen and Owen applications are with respect to the lamp current pulses, and control circuit 9 should accordingly be suitably adjusted to operate transistor switch 5 in such a manner as to provide the desired lamp current pulse repetition rate and duty cycle.

Figure 1A:
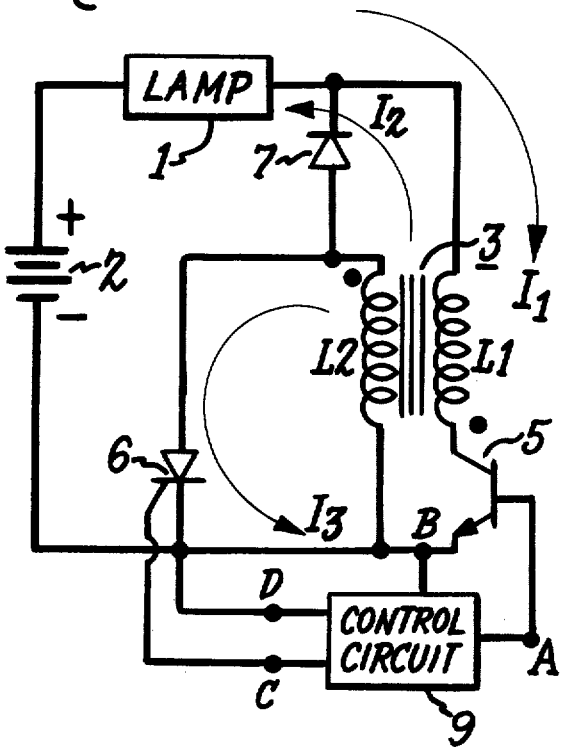
Figure 1B:
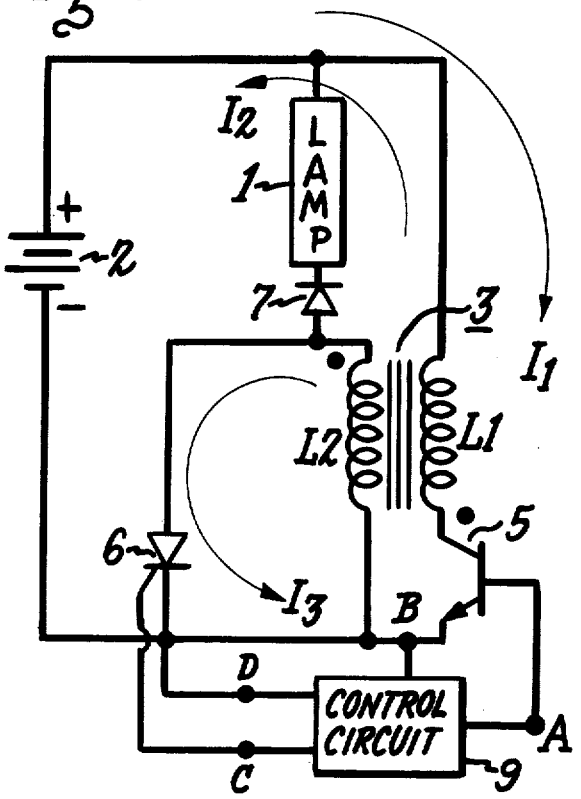
Figure 3:
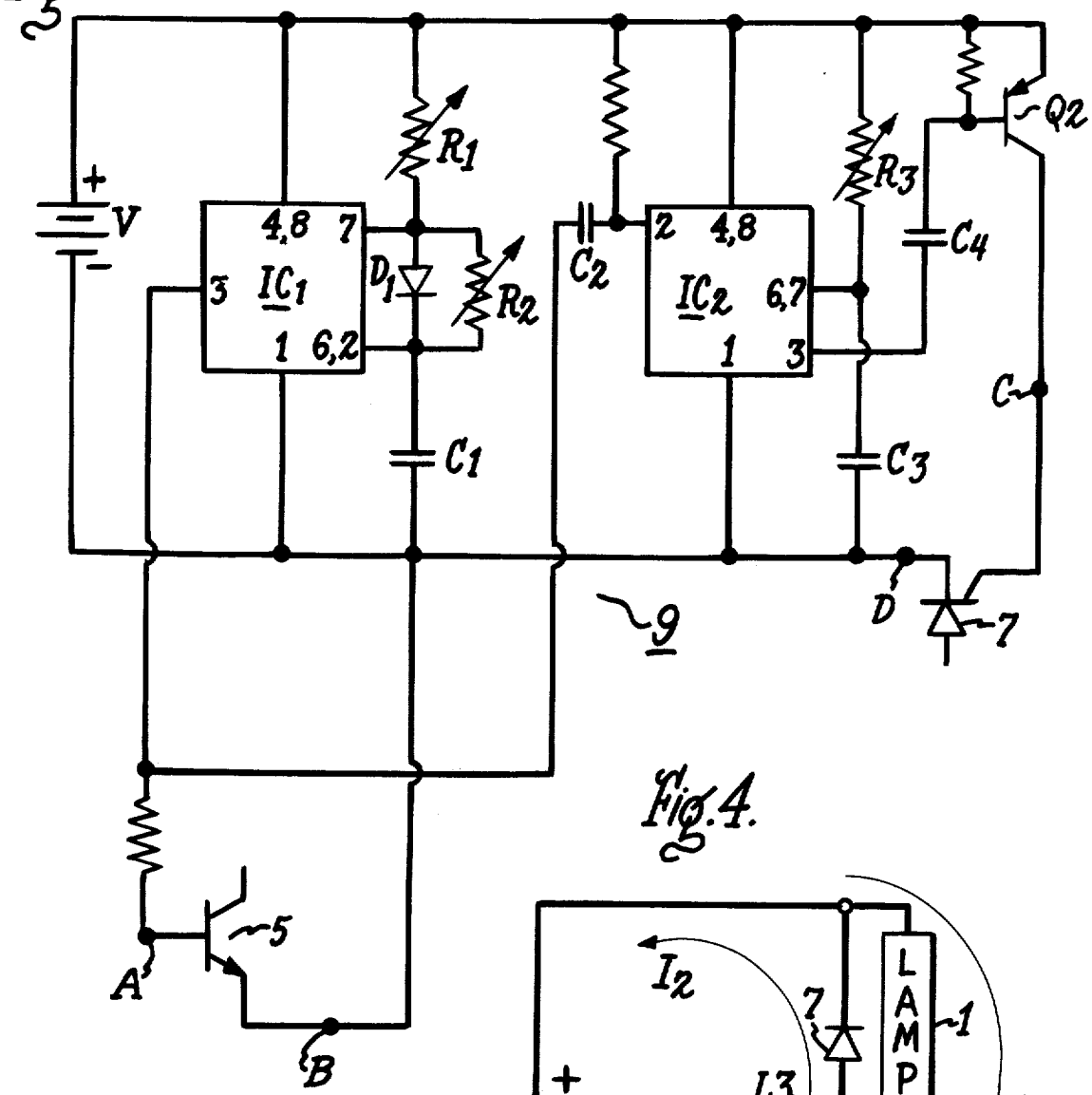
FIG. 3 is a circuit diagram of the control circuit shown in FIGS. 1, 1*a* and 1*b.

FIG. 3 is a circuit diagram of control circuit 9 shown in FIGS. 1*a* and 1*b*, wherein the control circuit has four output terminals A, B, C, D, with terminals A and B connected to transistor 5 respectively at the base and emitter thereof, and terminals C and D connected to SCR switch 6 respectively at the gate and cathode thereof. The function of control circuit 9 is to produce a base drive current in transistor 5 for closing that switch and to remove the base drive current to open the switch, the base drive being produced between terminals A and B. In addition, the control circuit produces a pulse of current at a sufficient voltage to trigger SCR 6 into conductive state, this pulse being produced between terminals C and D. For a pulse repetition rate of 1 kHz, a typical timing for operation of transistor 5 and SCR 6 (see FIG. 2) when $t_o = 0$ would be $t_1 = 100$ microseconds and $t_2 = 200$ microseconds.

The control circuit shown in FIG. 3 comprises two timing networks each consisting of a 555 type integrated circuit and associated circuitry. The integrated circuits, shown as $IC_1$ and $IC_2$, may be obtained commercially as type NE555 from Signetics Corporation.

The pins indicated for the illustrated IC circuits have the following functions: pin 1 is the power supply common (negative) voltage, pin 2 is the trigger input, pin 3 is the output voltage, pin 4 is the reset input, pin 6 is the threshold input, pin 7 is the discharge output, and pin 8 is the positive power supply input. The IC consists of a bistable circuit whose output voltage is either high (near positive power supply voltage) or low (near common or negative power supply voltage). The circuit is triggered into the high state when the voltage at trigger pin 2 goes below 1/3 V, where V is the power supply voltage. The circuit is triggered into the low state when the voltage at the threshold pin 6 goes above 2/3 V. The discharge pin 7 exhibits a short circuit to power supply common (pin 1) when the circuit is in the low state.

The timing network associated with $IC_1$ forms an astable multivibrator, whose output voltage has a waveform substantially like the base drive current waveform for switch 5 as shown in FIG. 2. It will be noted that pins 2 and 6 are both connected to timing capacitor $C_1$. Thus, when the voltage on $C_1$ goes higher than 2/3 V, threshold input pin 6 will cause the output voltage (pin 3) to go low and the discharge output (pin 7) shorts to pin 1. When the voltage on $C_1$ goes below 1/3 V, the trigger input (pin 2) will cause the output voltage to go high, and the short between the discharge output and pin 1 is removed, i.e., the discharge output is turned off. In the operation of this circuit, assuming that the voltage on capacitor $C_1$ has dropped to 1/3 V, the output voltage at pin 3 is then high, and the discharge output (pin 7) is turned off. Then $C_1$ will charge through variable resistor $R_1$ and diode $D_1$ with a time constant $R_1C_1$. When the voltage on $C_1$ reaches 2/3 V, the output voltage will go low, and pin 7 is shortened to pin 1, resulting in discharge of capacitor $C_1$ through variable resistor $R_2$ and pins 7 and 1 with a time constant $R_2C_1$. When the voltage on $C_1$ reaches 1/3 V, the cycle begins again.

The timing network associated with $IC_2$ forms a monostable multivibrator. When the output voltage of $IC_1$ (pin 3) goes low, a negative pulse is applied through capacitor $C_2$ to the trigger input (pin 2) of $IC_2$. This causes the output of $IC_2$ to go high and pin 7 to turn off. Then capacitor $C_3$ begins charging from zero volts through resistor $R_3$ with a time constant $R_3C_3$. When the voltage on $C_3$ reaches 2/3 V, the output voltage goes low, and $C_3$ discharges through pins 7 and 1. The output then remains low until another trigger pulse is received from $IC_1$. The output pulse is then differentiated by capacitor $C_4$ and the negative transition of this output pulse is amplified and inverted by transistor $Q_2$. This pulse is applied to the gate of SCR 6, as shown in FIG. 3, to turn on the SCR.

The timing operation in terms of the waveforms shown in FIG. 2 is such that at time $t_o$, $IC_1$ goes high, turning on transistor switch 5. At time, $t_1$, $IC_1$ goes low, turning off switch 5 and triggering $IC_2$. At time $t_2$, $IC_2$ turns off (goes low), causing SCR switch 6 to be triggered on. A broad pulse is produced by $IC_1$ between time $t_o$ and time $t_1$, such as shown characterizing the switch drive current in FIG. 2, and a narrow pulse (not shown) is produced by the action of $IC_2$ at time $t_2$ to gate the SCR on. After some time delay, $IC_1$ again goes high, thus beginning a new cycle.

The present invention is an improvement on the circuit disclosed in co-pending application of Knoble and Owen, Ser. No. 719,765, filed 9/2/76, and assigned to the same assignee as the present invention. In the present circuit, the provision of controlled switch 6 connected across transformer secondary winding L2 provides for energy to be stored in the transformer for a relatively long time and results in faster rise times of the lamp current pulses, as compared to the circuit of the aforesaid co-pending application.

The present invention is also somewhat related to the circuit disclosed in co-pending application of Knoble and Morais, Ser. No. 719,764, filed 9/2/76, and assigned to the same assignee as the present invention. In the present circuit, the increment of energy $\Delta E$ is returned to the power supply as hereinabove described, in contrast to the circuit of the latter co-pending application where this energy is dissipated in the lamp.

FIG. 1*a* shows a modification of the FIG. 1 circuit wherein the lamp is located in the main supply line in series between the DC supply and the junction of the described parallel branches containing the transformer primary and secondary windings, respectively. In such arrangement, the pulses applied to the lamp during operation will have a waveform characterized by a composite of the waveforms for $I_1$ and $I_2$ as shown in FIG. 2.

FIG. 1*b* shows another modification of the circuit wherein the lamp is located in the secondary winding branch in series with L2 and diode 7. In this case, the waveform of the lamp current will be like that shown for $I_2$ in FIG. 2.

Figure 4:
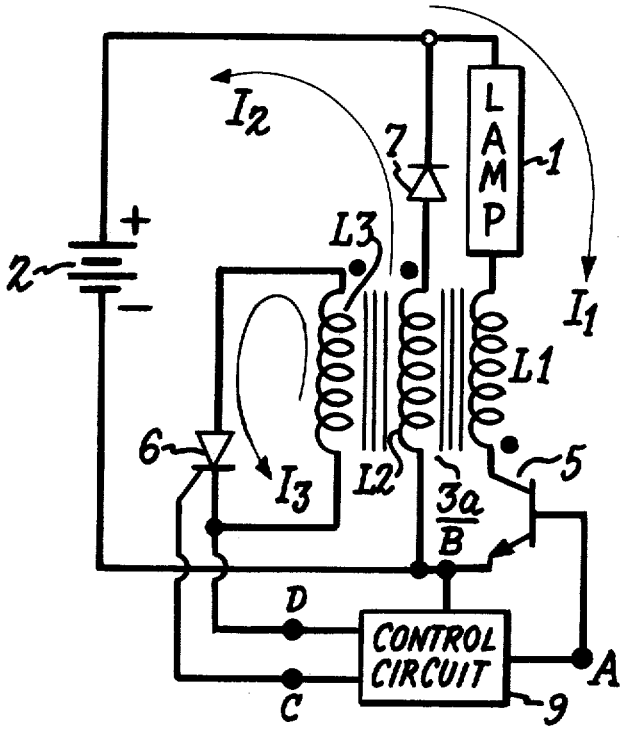
* and FIG. 4 shows another modification of the FIG. 1 circuit.

FIG. 4 shows another modification of the circuit of the present invention wherein transformer 3*a* includes tertiary or auxiliary winding L3, which may be tightly or lossely coupled to the primary and secondary windings, and SCR switch 6 is connected across tertiary winding L3. The operation of this circuit is essentially the same as the above-described circuits, except that in this case currents $I_2$ and $I_3$ would not go through the same winding. This provides the advantage that SCR 6 and diode 7 may be selected as to current and voltage rating with reference only to the respective transformer winding to which they are connected. In addition, the SCR is isolated from the power supply, with the attendant advantages thereof.

The DC supply source 2 is shown and described as a battery, but it will be understood that other forms of DC supply may be employed, as for example a circuit including a rectifier connected to an AC source and a filter capacitor connected to the output of the rectifier, such as shown in the aforementioned co-pending application of Knoble and Morais.

While an independent DC voltage supply V, which may typically be about 15 volts, is shown connected to the control circuit in FIG. 3, it will be understood that, if desired, the control circuit may be connected to the DC supply of the power circuit, with the provision of suitable means for reducing the voltage.

Although particular types of controlled switches 5 and 6 are shown and described, it will be understood that other types of controlled switches may be employed for either or both of these components, as appropriate.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What I claim as new and desire to obtain by Letters Patent of the United States is:

1. A lamp operating circuit comprising, in combination, a direct current power source, a first branch including first controlled switch means across said power source, a second branch including unidirectional conducting means across said power source, a transformer having a primary winding in said first branch in series with said first controlled switch means and a secondary winding in said branch in series with said unidirectional conducting means, means for connecting a gaseous discharge lamp to said power source in series with at least one of said branches, second controlled switch means coupled to said secondary winding for substantially stopping current flow to said unidirectional conducting means and for storing magnetic energy in said transformer while said second controlled switch means is on, and control means coupled to said first and second controlled switch means for repetitively and sequentially operating the same at predetermined intervals, whereby DC pulses may be applied to the gaseous discharge lamp for operation thereof.

2. A circuit as defined in claim 1, said second controlled switch means being connected across said secondary winding.

3. A circuit as defined in claim 1, said transformer including a tertiary winding magnetically coupled to said secondary winding, said second controlled switch means being connected across said tertiary winding.

4. A circuit as defined in claim 1, said lamp connecting means being in said first branch in series with said first controlled switch means and said primary winding.

5. A circuit as defined in claim 4, said primary winding being connected between said lamp connecting means and said first controlled switch means.

6. A circuit as defined in claim 1, said lamp connecting means being in said second branch in series with said unidirectional conducting means and said secondary winding.

7. A circuit as defined in claim 1, said lamp connecting means being connected in series between said power source and the junction of said first and second branches.

8. A circuit as defined in claim 1, said first controlled switch means comprising a transistor having a base electrode, said second controlled switch means comprising a unidirectional controlled switch having a gate electrode, said control means connected to said base electrode and said gate electrode.

9. A circuit as defined in claim 8, said unidirectional controlled switch comprising a silicon controlled rectifier.

10. A circuit as defined in claim 1, said control means having timing network means comprising first and second multivibrator circuits connected respectively to said first and second controlled switch means, said first multivibrator circuit connected to said second multivibrator circuit for controlling the operation thereof.

11. A circuit as defined in claim 10, said first multivibrator circuit comprising an astable multivibrator circuit and said second multivibrator circuit comprising a monostable multivibrator circuit.

12. A circuit as defined in claim 1, and a gaseous discharge lamp connected to said lamp connecting means.

13. A circuit as defined in claim 12, said gaseous discharge lamp comprising a high pressure sodium vapor lamp.

14. A circuit as defined in claim 12, said gaseous discharge lamp comprising mixed metal vapors.

15. A circuit as defined in claim 1, said unidirectional conducting means comprising a diode.

16. A circuit as defined in claim 1, said unidirectional conducting means, said secondary winding and said second controlled switch means being arranged such that when said first controlled switch means is on, the current flows in one direction from said power source toward said first branch, and when said first and second controlled switch means are off the current flows in the opposite direction toward said power source from said second branch, and when said second controlled switch means is on, the current circulates in a loop comprising said second controlled switch means and a portion of said transformer.

17. A circuit as defined in claim 1, said primary winding and said secondary winding being arranged so as to be out of phase relative to one another.

* * * * *